US011215128B1

(12) United States Patent
Poirier et al.

(10) Patent No.: US 11,215,128 B1
(45) Date of Patent: Jan. 4, 2022

(54) ACCELERATION CONTROL METHOD FOR MARINE ENGINE

(71) Applicant: Brunswick Corporation, Mettawa, IL (US)

(72) Inventors: Justin R. Poirier, Fond du Lac, WI (US); Brett Bielefeld, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 251 days.

(21) Appl. No.: 16/540,876

(22) Filed: Aug. 14, 2019

Related U.S. Application Data

(60) Provisional application No. 62/718,575, filed on Aug. 14, 2018.

(51) Int. Cl.

| | |
|---|---|
| ***F02D 29/02*** | (2006.01) |
| ***F02B 61/04*** | (2006.01) |
| ***F02D 41/10*** | (2006.01) |
| ***B63H 21/14*** | (2006.01) |
| ***B63H 21/22*** | (2006.01) |
| ***B63H 25/42*** | (2006.01) |

(52) U.S. Cl.
CPC ..... *F02D 29/02* (2013.01); *B63H 21/14* (2013.01); *B63H 21/22* (2013.01); *F02B 61/045* (2013.01); *F02D 41/10* (2013.01); *B63H 25/42* (2013.01); *F02D 2200/101* (2013.01); *F02D 2250/18* (2013.01)

(58) Field of Classification Search
CPC .... F02D 29/02; F02D 41/10; F02D 2200/101; F02D 2250/18; F02B 61/045; B63H 21/22; B63H 21/14; B63H 25/42
See application file for complete search history.

(56) References Cited

U.S. PATENT DOCUMENTS 3,823,801 A 7/1974 Arnold
3,994,254 A 11/1976 Woodfill
(Continued)

FOREIGN PATENT DOCUMENTS

GB 1530959 11/1978

OTHER PUBLICATIONS

Bielefeld, Brett, "System and Method for Controlling a Transmission on a Marine Engine," Unpublished U.S. Appl. No. 16/171,056, filed Oct. 25, 2018.

*Primary Examiner* — Joseph J Dallo
*Assistant Examiner* — Kurt Philip Liethen
(74) *Attorney, Agent, or Firm* — Andrus Intellectual Property Law, LLP

(57) ABSTRACT

A method for controlling a speed of a propeller of a marine propulsion device during launch of a marine vessel comprises receiving a command to initiate an enhanced launch feature of the marine vessel. The method includes increasing a speed of an engine of the marine propulsion device in response to the enhanced launch feature command. While the engine speed increases, the method includes commanding a first amount of engagement of a forward gear controlling torque transfer from an output shaft of the engine to an input shaft of the propeller. After the engine speed reaches a predetermined threshold, the method includes commanding a second, greater amount of engagement of the forward gear controlling torque transfer from the engine output shaft to the propeller input shaft.

15 Claims, 5 Drawing Sheets

(56) References Cited

U.S. PATENT DOCUMENTS

| | | | | |
|---|---|---|---|---|
| 4,027,758 | A | 6/1977 | Gustavsson et al. | |
| 5,474,480 | A * | 12/1995 | Schwarz | B63H 21/22 440/86 |
| 6,176,750 | B1 | 1/2001 | Alexander et al. | |
| 6,554,663 | B2 * | 4/2003 | Neisen | B63H 20/20 440/75 |
| 7,214,110 | B1 * | 5/2007 | Ehlers | B63H 21/14 440/1 |
| 7,361,067 | B1 | 4/2008 | Smedema | |
| 8,255,133 | B2 | 8/2012 | Ahn | |
| 8,439,800 | B1 | 5/2013 | Bazan et al. | |
| 8,690,621 | B2 * | 4/2014 | Kuriyagawa | B63H 21/21 440/86 |
| 8,751,075 | B2 | 6/2014 | Leehaug et al. | |
| 9,039,468 | B1 | 5/2015 | Arbuckle et al. | |
| 9,233,744 | B2 * | 1/2016 | Clever | B63H 21/21 |
| 9,248,898 | B1 | 2/2016 | Kirchhoff et al. | |
| 9,441,724 | B1 | 9/2016 | Pugh | |
| 9,446,829 | B1 | 9/2016 | Williams et al. | |
| 9,718,527 | B2 * | 8/2017 | Ito | B63B 34/60 |
| 9,896,178 | B1 | 2/2018 | Przybyl et al. | |
| 10,752,328 | B1 * | 8/2020 | Bielefeld | B63H 20/14 |
| 10,766,592 | B1 * | 9/2020 | Przybyl | F02D 25/00 |
| 10,794,474 | B1 * | 10/2020 | Bielefeld | F16H 61/0213 |
| 2007/0180941 | A1 * | 8/2007 | Mowbray | B63H 20/20 74/335 |
| 2018/0043980 | A1 | 2/2018 | Przybyl et al. | |

* cited by examiner

ACCELERATION CONTROL METHOD FOR MARINE ENGINE

CROSS-REFERENCE TO RELATED APPLICATION

This application claims the benefit of U.S. Provisional Application Ser. No. 62/718,575, filed Aug. 14, 2018, which is hereby incorporated by reference herein in its entirety.

FIELD

The present disclosure relates to marine engines equipped with a wet clutch and optionally a trolling valve.

BACKGROUND

GB Patent Application Publication No. 1530959A discloses an automatic change-gear assembly for a water-jet boat propulsion system having an input shaft linked to an output shaft via a one-way clutch and an overdrive system comprising gears meshing with gears on the input and output shafts respectively, the gears being drivingly interconnectible by a fluid actuated multiplate clutch. Clutch is engaged when fluid pressure in a throttled passageway in a layshaft carrying the gears builds up to displace annular piston with gear. Fluid pressure is supplied by a pump when a lubricating by-pass valve is closed by a solenoid. Valve is normally closed at low speeds, and thus drive is effected through the overdrive, the gear change to direct drive taking place in response to one of the following; maximum engine throttle-opening, predetermined engine speed, predetermined boat speed or a manual override, or dis-engagement of the direct-drive by a neutral switch. In a modification there are two overdrives, having different drive ratios, and operative sequentially.

U.S. Pat. No. 6,176,750 discloses an improved hydraulic system for a twin propeller marine propulsion unit. A vertical drive shaft is operably connected to the engine of the propulsion unit and carries a pinion that drives a pair of coaxial bevel gears. An inner propeller shaft and an outer propeller shaft are mounted concentrically in the lower torpedo section of the gear case and each propeller shaft carries a propeller. To provide forward movement for the watercraft, a sliding clutch is moved in one direction to operably connect the first of the bevel gears with the inner propeller shaft to drive the rear propeller. A hydraulically operated multi-disc clutch is actuated when engine speed reaches a pre-selected elevated value to operably connect the second of the bevel gears to the outer propeller shaft, to thereby drive the second propeller in the opposite direction. The hydraulic system for actuating the multi-disc clutch includes a pump connected to the inner propeller shaft, and the pump has an inlet communicating with a fluid reservoir in the gear case and has an outlet which is connected through a hydraulic line to the multi-disc clutch. A strainer, a pressure regulator and a valve mechanism are disposed in the lower gear case and are located in series in the hydraulic line. At idle and slow operating speeds the valve is held by a solenoid in a position where the fluid is dumped to the reservoir, so that the pressure of the fluid being directed to the multi-disc clutch is insufficient to engage the clutch. At engine speeds above a preselected value, the solenoid is deenergized and the valve is then biased to a position where the fluid is delivered to the multi-disc clutch to engage the clutch and cause operation of the second propeller.

U.S. Pat. No. 7,361,067 discloses a system that stores data relating to the operation of a marine vessel during a water skier launch procedure. The data can include a plurality of throttle handle positions that are stored at a frequency which is suitable for reproducing the movement profile of the handle during a launch procedure. The water skier launch profile is then stored so that it can be recalled and reactivated to repeat the acceleration profile of the boat.

U.S. Pat. No. 8,439,800 discloses a shift control system for a marine drive that applies partial clutch engagement pressure upon initial shifting from forward to reverse to prevent stalling of the engine otherwise caused by applying full clutch engagement pressure upon shifting from forward to reverse.

U.S. Pat. No. 9,441,724 discloses a method of monitoring and controlling a transmission in a marine propulsion device comprising the steps of receiving a rotational input speed of an input shaft to the transmission, receiving a rotational output speed of an output shaft from the transmission, receiving a shift actuator position value, and receiving an engine torque value. The method further comprises calculating a speed differential based on the input speed and the output speed, and generating a slip profile based on a range of speed differentials, engine torque values, and shift actuator position values.

The above-noted patents and applications are hereby incorporated by reference herein, in their entireties.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to the present disclosure, a wet clutch and optionally a trolling valve in a marine engine are utilized to allow the engine to spool up to a desired engine speed before the transmission fully engages forward gear. Such a methodology can be used to enhance launch of a marine vessel powered by the marine engine.

One example of the present disclosure is of a method for controlling a speed of a propeller of a marine propulsion device during launch of a marine vessel. The method is carried out by a control module and comprises receiving a command to initiate an enhanced launch feature of the marine vessel. The method next includes increasing a speed of an engine of the marine propulsion device in response to the enhanced launch feature command. While the engine speed increases, the method includes commanding a first amount of engagement of a forward gear controlling torque transfer from an output shaft of the engine to an input shaft of the propeller. After the engine speed reaches a predetermined threshold, the method includes commanding a second, greater amount of engagement of the forward gear controlling torque transfer from the engine output shaft to the propeller input shaft.

According to another example, a system for a marine vessel includes a marine propulsion device having an engine coupled via a transmission to a propeller, a control module controlling the marine propulsion device, and an operator input device in signal communication with the control module. The control module is configured to carry out an enhanced launch algorithm in response to an enhanced launch feature command from the operator input device. The control module increases a speed of the engine in response to the enhanced launch feature command. While the engine speed increases, the control module controls the transmission to provide a first amount of power-transferring engagement between the engine and the propeller. After the engine speeds reaches a predetermined threshold, the control module controls the transmission to provide a second, greater amount of power-transferring engagement between the engine and the propeller shaft.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible.

Figure 1:
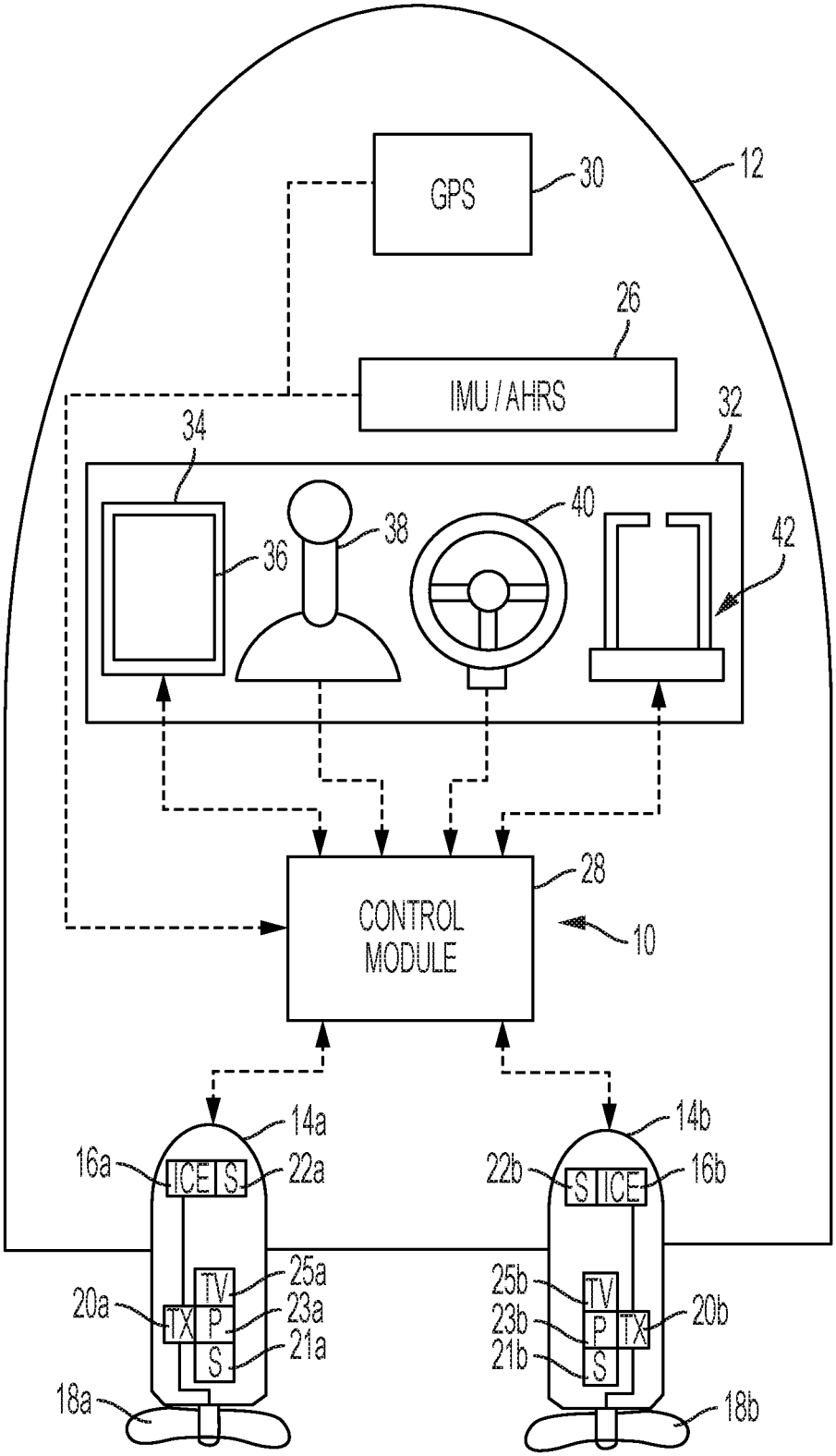
FIG. 1 illustrates one example of a marine vessel including a marine propulsion system according to the present disclosure.

FIG. 1 illustrates a marine propulsion system 10 for a marine vessel 12. The marine propulsion system 10 includes two marine propulsion devices 14*a*, 14*b*, but one or more than two marine propulsion devices could instead be provided. The marine propulsion devices 14*a*, 14*b* shown herein are outboard motors, but the marine propulsion devices could instead be inboard motors, stern drives, pod drives, jet drives, etc. Each marine propulsion device 14*a*, 14*b* includes an engine 16*a* or 16*b*. The engines 16*a*, 16*b* shown here are internal combustion engines, which may be, for example, gasoline or diesel engines. Each marine propulsion device 14*a*, 14*b* also includes a propeller 18*a* or 18*b* configured to be coupled in torque-transmitting relationship with a respective engine 16*a* or 16*b*. Such torque-transmitting relationship is more specifically provided by way of a transmission 20*a* or 20*b* configured to transmit torque from a respective engine 16*a* or 16*b* to a respective propeller 18*a* or 18*b*. As will described further herein below with respect to FIG. 2, each transmission 20*a*, 20*b* is configured to transmit torque from the engine 16*a* or 16*b* to the propeller 18*a* or 18*b* at one of at least a first gear ratio and a second gear ratio, although additional gear ratios such as, for example, third, fourth, fifth, etc. gear ratios could be provided. Alternatively, only a single forward gear ratio may be provided.

The marine propulsion system 10 further includes engine speed sensors 22*a*, 22*b* measuring a speed of a respective engine 16*a*, 16*b*. In one example, the engine speed sensors 22*a*, 22*b* may be shaft rotational speed sensors (e.g., tachometers), which measure a speed of the engine 16*a* or 16*b* in rotations per minute (RPM), as is known to those having ordinary skill in the art. Each transmission 20*a*, 20*b* includes a transmission output speed (TOS) sensor 21*a*, 21*b* that measures an output speed of the respective transmission 20*a*, 20*b* in RPM. The TOS sensors 21*a*, 21*b* may be of a type similar to that of the engine speed sensors 22*a*, 22*b*. Clutch pressure sensors 23*a*, 23*b* are also provided in connection with the respective transmissions 20*a*, 20*b*. Clutch pressure sensors 23*a*, 23*b* can be pressure transducers in the hydraulic circuit(s) associated with the clutches of the transmissions 20*a*, 20*b*. Trolling valves 25*a*, 25*b* are also provided for each marine propulsion device 14*a*, 14*b*, and will be described further herein below.

The marine propulsion system 10 also includes a control module 28 in signal communication with the engines 16*a*, 16*b* and the transmissions 20*a*, 20*b*, as well as their associated sensors and valves and other components noted herein below. The control module 28 is programmable and includes a processor and a memory. The control module 28 can be located anywhere in the marine propulsion system 10 and/or located remote from the marine propulsion system 10 and can communicate with various components of the marine vessel 12 via a peripheral interface and wired and/or wireless links, as will be explained further herein below. Although FIG. 1 shows one control module 28, the marine propulsion system 10 can include more than one control module. Portions of the methods disclosed herein below can be carried out by a single control module or by several separate control modules. For example, the marine propulsion system 10 can have control modules located at or near a helm 32 of the marine vessel 12 and can also have control module(s) located at or near the marine propulsion devices 14*a*, 14*b*. If more than one control module is provided, each can control operation of a specific device or sub-system on the marine vessel 12.

In some examples, the control module 28 may include a computing system that includes a processing system, storage system, software, and input/output (I/O) interfaces for communicating with peripheral devices. The systems may be implemented in hardware and/or software that carries out a programmed set of instructions. As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple control modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The control module 28 communicates with one or more components of the marine propulsion system 10 via the I/O interfaces and a communication link, which can be a wired or wireless link. In one example, the communication link is a controller area network (CAN) bus, but other types of links could be used. It should be noted that the extent of connections of the communication link shown herein is for schematic purposes only, and the communication link in fact provides communication between the control module 28 and each of the peripheral devices noted herein, although not every connection is shown in the drawing for purposes of clarity.

The marine propulsion system 10 also includes a global positioning system (GPS) 30 that provides location and speed of the marine vessel 12 to the control module 28. Additionally or alternatively, a vessel speed sensor such as a Pitot tube or a paddle wheel could be provided. The marine propulsion system 10 may also include an inertial measurement unit (IMU) or an attitude and heading reference system (AHRS) 26. An IMU has a solid state, rate gyro electronic compass that indicates the vessel heading and solid state accelerometers and angular rate sensors that sense the vessel's attitude and rate of turn. An AHRS provides 3D orientation of the marine vessel 12 by integrating gyroscopic measurements, accelerometer data, and magnetometer data. The IMU/AHRS 26 could be GPS-enabled, in which case a separate GPS 30 would not be required.

Further, the marine propulsion system 10 includes a number of operator input devices located at the helm 32 of the marine vessel 12. The operator input devices include a multi-functional display device 34 including a user interface 36. The user interface 36 may be an interactive, touch-capable display screen, a keypad, a display screen and keypad combination, a track ball and display screen combination, or any other type of user interface known to those having ordinary skill in the art for communicating with a multi-functional display device 34. A joystick 38 is also provided at the helm 32 and allows an operator of the marine vessel 12 to command the marine vessel 12 to translate or rotate in any number of directions. A steering wheel 40 is provided for providing steering commands to the marine propulsion devices 14*a*, 14*b* or to a rudder, in the event that the marine propulsion devices are not steerable. A throttle lever 42 is also provided for providing thrust commands, including both a magnitude and a direction of thrust, to the control module 28. Here, two throttle levers are shown, each of which can be used to control a respective one of the marine propulsion devices 14*a* or 14*b*, although the two levers can be controlled together as a single lever. Alternatively, a single lever could be provided for controlling both marine propulsion devices 14*a*, 14*b*.

Several of the operator input devices at the helm 32 can be used to input an operator demand on the engines 16*a*, 16*b* to the control module 28, including the user interface 36 of the multi-functional display device 34, the joystick 38, and the throttle lever 42. By way of example, a rotation of the throttle lever 42 in a forward direction away from its neutral, detent position could be interpreted as a value from 0% to 100% operator demand corresponding via an input/output map, such as a look up table stored in a memory of the control module 28, to a position of the throttle valves of the engines 16*a*, 16*b*. For example, the input/output map might dictate that the throttle valves are fully closed when the throttle lever 42 is in the forward, detent position (i.e., 0% demand), and are fully open when the throttle lever 42 is pushed forward to its furthest extent (i.e., 100% demand).

Figure 2:
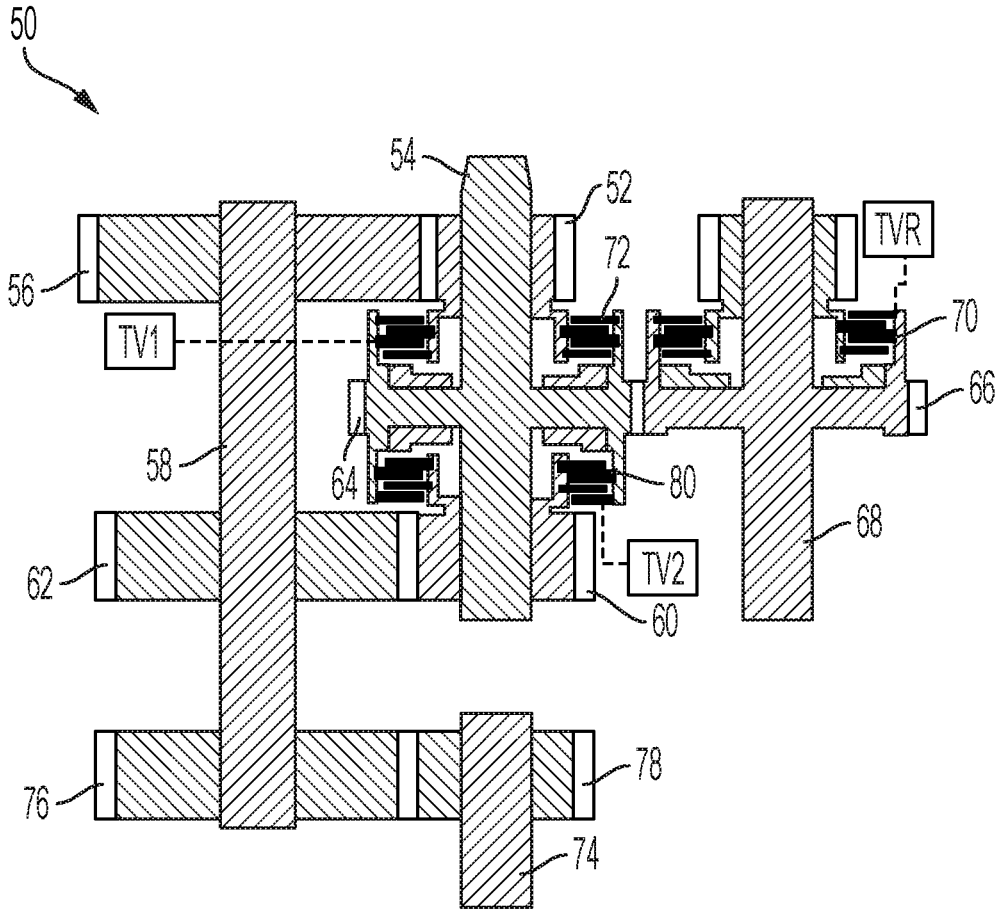
FIG. 2 is a schematic illustrating one example of a transmission for an engine powering a marine propulsion device according to the present disclosure.

One schematic example of a multi-speed transmission 50 (which can be used as transmission 20*a* or 20*b*) is shown in cross-section in FIG. 2. The transmission 50 shown herein is a two-speed layshaft transmission, but other transmissions, such as epicyclic (planetary), dual-clutch, continuously variable, or of other known type could be used. The transmission 50 shown herein has two forward gear ratios, provided by a first input gear 52 on input shaft 54 (which is coupled to an output shaft of the engine 16*a* or 16*b*, as is known) and a first counter gear 56 on countershaft 58, and by a second input gear 60 and a second counter gear 62 on countershaft 58. Alternatively, fewer or more than two forward gear ratios could be provided. A reverse gear 64 is also provided on input shaft 54, and meshes with reverse gear 66 on reverse shaft 68, but will not be described further herein, other than to say reverse rotation of the propeller 18*a* or 18*b* is accomplished by way of actuating reverse clutch 70, as is known.

A first-gear clutch 72 is provided for placing the transmission 50 in first gear, such that first input gear 52 and first counter gear 56 transmit torque to output shaft 74 via output counter gear 76 and output gear 78 at a first gear ratio. A second-gear clutch 80 is provided for placing the transmission 50 in second gear, such that second input gear 60 and second counter gear 62 transmit torque to output shaft 74 via output counter gear 76 and output gear 78 at a second gear ratio. In one example, the first gear ratio is higher than the second gear ratio. Thus, when the transmission 50 transmits torque from the engine 16*a* or 16*b*, via the input shaft 54, the first gears 52, 56, the output gears 76, 78, and the output shaft 74 to the propeller 18*a* or 18*b* (via a propeller shaft that is coupled to the output shaft 74 in a known manner) the transmission 50 provides more torque and less speed than it would provide were it to be placed in second gear, engine input speed being equal. Note that the clutches 70, 72, 80 shown herein are multi-plate wet disc clutches, and each is provided with a trolling valve TV1, TV2, TVR (schematically represented in FIG. 1 as trolling valves 25*a*, 25*b*).

In inboard motors, for example, it is known to couple a trolling valve to a forward clutch and a reverse clutch in a marine engine's transmission. The forward and reverse clutches engage forward and reverse gears, respectively, via pressure plates of a wet clutch. One example of such a system is described in U.S. Pat. No. 8,439,800, which was incorporated by reference herein above. The amount of engagement of the clutches with the gears can optionally be controlled by the trolling valves, where engagement can range from not engaged (100% slip) to fully engaged (0% slip). Control over slip results in control over the resulting speed of the propeller on the marine propulsion device, as more or less rotational power from the output shaft of the engine is transmitted to the forward or reverse gear, which in turn provides more or less torque to the propeller shaft. Therefore, a higher percentage of slip leads to lower propeller speeds (and thus lower boat speeds), and a lower percentage of slip leads to higher propeller speeds (and thus higher boat speeds).

According to the present disclosure, the trolling valves TVR, TV1, TV2 may be configured to receive control signals from the control module 28 and responsively control an amount of hydraulic fluid to the respective clutches 70, 72, 80, thus controlling the amount of engagement of the clutches 70, 72, 80 with their respective gears 66, 52, 60. Although the valves are referred to as "trolling" valves, thus implying a specific application on marine vessels for trolling (low-speed) operations, the valves TVR, TV1, TV2 may be used in any of a variety of other applications for the purpose of controlling an amount of hydraulic fluid to the clutches 70, 72, 80. For example, as will be discussed herein below, the trolling valves TVR, TV1, TV2 can be used in order to carry out a method for enhancing launch of the marine vessel 12.

The present inventors have sought, through research and development, to increase the amount of torque available to the propeller shafts of the marine propulsion devices 14*a*, 14*b* upon launch of the marine vessel 12. The present inventors have discovered that it is desirable to allow the engines 16*a*, 16*b* of the marine propulsion devices 14*a*, 14*b* to spool up (i.e., increase in engine speed) before engaging the engines' output shafts with the propulsion devices' propeller shafts. This increases the amount of torque available to the propeller shafts immediately upon launch, thereby providing improved thrust control options.

Currently, most outboard motor marine engines use non-slipping (dog-tooth) clutches. Non-slipping clutches cannot be smoothly meshed at high speed, which prohibits a shift into gear at high engine speeds. This limits the amount of thrust available from the outboard motor during the early stages of vessel launch.

Propeller vents currently allow outboard marine engines to spool up to speed. As the marine vessel 12 accelerates, exhaust gases are drawn out of vent holes behind each propeller blade to aerate the water, which allows engine speed to rise more rapidly for quicker acceleration. (Too much air, however, will cause a propeller to over-ventilate and a resulting loss of thrust.) Once the marine vessel 12 is on-plane, the speed of the water flowing over the vent holes seals the exhaust in so that the propeller operates in solid, non-aerated water and has no effect on top speed. However, propeller vents may also lower the propeller's efficiency and thrust during launch.

Presenting an advancement over dog-tooth clutches and propeller vents, and seizing upon the benefits of trolling valves, the present inventors have developed methods for allowing the engines 16*a*, 16*b* to spool up to a desired engine speed before engaging the engines' output shafts with the propulsion devices' propeller shafts in a torque-transmitting relationship. The present methods can be carried out "manually," at the selection of an operator, or automatically, at the selection of the control module 28. For example, during manual implementation, the engines 16*a*, 16*b* can be allowed to spool up to a desired speed before the operator selects to "dump" the clutch and engage the engine output with the propeller input. During automated implementation, rather than depending on the operator to "dump" the clutch, engine speed can be controlled and clutch pressure modulated with a feedback loop to achieve a target transmission output speed (TOS) and acceleration profile.

With respect to manual initiation of the present method, launch of the marine vessel 12 can be initiated by pushing both levers of the throttle lever 42 at the helm 32 forward at a quick, steady pace. Alternatively, a "launch" button or other user-input can be selected, such as via the user interface 36, which is pre-programmed to start a control sequence that accelerates the marine vessel 12 according to a launch profile saved in a memory of the control module 28. Examples of both launch sequences are further described in U.S. Pat. No. 7,361,067, which was incorporated by reference herein above. In any event, the operator can then monitor the engines' speeds on a gauge, which may be a separate instrument provided at the helm 32 and/or a virtual gauge displayed on the user interface 36. Once the engine speeds are at a value desired by the operator, the operator can make a selection, again via a button or other user-input, which commands each first-gear clutch 72 to engage with each first input gear 52 in both transmissions 20*a*, 20*b*. In other examples, the same or another gauge (whether it be a physical instrument or a virtual display) could be used to indicate to the operator that the engine speeds have spooled to a speed at which enhanced launch is available, such as by flashing the numbers showing the engines' RPMs, by flashing a written message, or by changing the display to a particular color. The operator could choose to engage the first-gear clutches 72 at any point after this message is relayed. The engine speed at or above which the enhanced launch mode would be available could be calibrated, and may vary depending on the engine and/or vessel application. In still another example, the marine propulsion system 10 is equipped with a user-selectable feature (e.g., button, menu option, etc. at the helm 32) that acts as a rev-limiter. When the rev-limiter feature is activated, the engines' speed will be held to a setpoint RPM even when the operator moves the throttle lever 42 to 100% demand. Alternatively, when the rev-limiter feature is activated, the engines 16*a*, 16*b* will move or increase their speed to a setpoint RPM, while the throttle lever 42 remains at 0% demand. In the latter example, the rev-limiter feature can be used as a manual override to idle control, after which the operator can move the throttle lever 42 to engage forward gear. In both rev-limiter examples, the setpoint RPM can be set during calibration and/or by the operator. In both examples, a position of a throttle lever 42 associated with the marine propulsion device 14*a*, 14*b* does not correspond to the engine speed.

With respect to automated initiation of the present method, launch of the marine vessel 12 can be initiated in the same ways noted herein above with respect to the manual initiation. Additionally, a separate button or other user-input could be provided at the helm 32, such as at the user interface 36, that allows the operator to select an enhanced launch mode before or immediately after pushing the throttle lever 42 forward or selecting the traditional "launch" feature. Alternatively, selection of a single button or other user input could immediately initiate the enhanced launch mode described herein, without requiring additional selection of a launch profile or movement of the throttle lever 42.

Instead of requiring the operator to manually dump the clutches, the trolling valves TV1 in each transmission 25*a*, 25*b* work in conjunction with the first-gear clutches 72 in the automated version of the method, allowing the first input gears 52 to be chosen while slipping the output shaft 74, thereby allowing the engines 16*a*, 16*b* to spool up before the first input gears 52 are completely engaged. Rather than bringing the first-gear clutches 72 and first input gears 52 together completely, the trolling valves TV1 are used to provide slip for a short, calibrated amount of time (for example, between 0.1-10 seconds) before the first input gears 52 are fully engaged with the first-gear clutches 72. This allows the first input gears 52 to gradually rise to the transmission input (or engine) speed, but faster than if the engine speeds had not first been spooled up.

Figure 3:
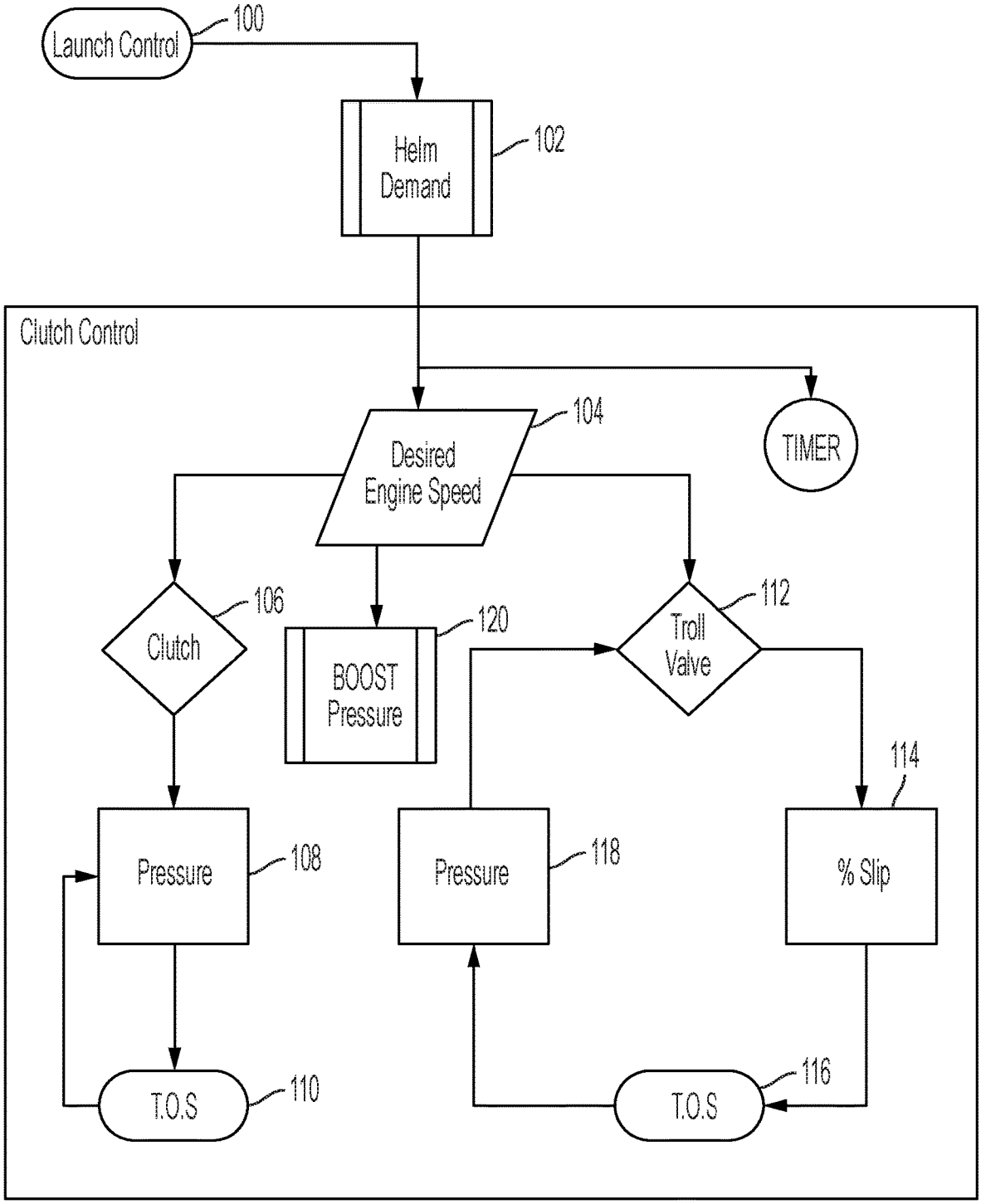
FIG. 3 illustrates a methodology for enhancing launch of the marine vessel using a wet disc clutch and a trolling valve.

FIG. 3 shows exemplary methodologies the control module 28 may use to carry out the automated version of the present disclosure. The control module 28 is provided with parameters such as the engine speeds from engine speed sensors 22*a*, 22*b*, the clutch pressures from clutch pressure sensors 23*a*, 23*b*, the transmission output speeds (TOS) from TOS sensors 21*a*, 21*b*, and vessel acceleration. The control module 28 can calculate the rate of change of the TOSs from TOS readings over time. The control module 28 could obtain vessel acceleration directly from the IMU/AHRS 26, or could calculate acceleration from vessel speed (from the GPS 30) over a period of time.

As shown at 100, the method may include receiving selection of an enhanced launch control mode, in one of the manners described herein above. At 102, a helm demand is received. This can be either the demand corresponding to the position of the throttle lever 42, if the throttle lever 42 was moved to initiate launch, or a pre-determined demand according to a calibrated launch profile. At 104, the engine speeds reach a desired engine speed (which can be calibrated or user-selected) at which the first-gear clutches 72 are to be engaged.

At 106, the control module 28 commands the first-gear clutches 72 to engage with the first input gears 52 by providing hydraulic fluid to the first-gear clutches 72 by way of a known hydraulic sump, pump, and valve/solenoid system. Clutch pressure is measured as shown at 108 (such as using pressure sensors 23*a*, 23*b*), and TOS is measured as shown at 110 (such as using TOS sensors 21*a*, 21*b*), as pressure increases due to provision of the hydraulic fluid. The control module 28 compares the pressure measured at 108 with a known pressure at full engagement of the first-gear clutch 72. Pressure feedback therefore provides the control module 28 with an estimate of how much slip is present between the transmission input and the transmission output. The clutch pressure increases until it reaches a value at which TOS is equal to transmission input speed (TIS), taking into account the transmissions' gear ratios (i.e., engine speed divided by gear ratio). At this point, the first-gear clutches 72 are fully engaged and full torque from the engines 16*a*, 16*b* is driving the propellers 18*a*, 18*b*. The clutch pressure readings can also be displayed to the operator as a diagnostic via a physical or virtual gauge. If the enhanced launch mode is implemented and there is not a continual increase in clutch pressure, the operator may be prompted to stop revving the engines 16*a*, 16*b*, such as by providing a notification via the same gauge or the user interface 36.

As shown at 112, the control module 28 can also control the trolling valves TV1 to modulate the amount of slip between TIS and TOS. A calibrated, decreasing amount of slip could be provided, as shown at 114. This slip would lead to a TOS at 116 that increased gradually, according to the decreasing slip. Clutch pressures are measured as shown at 118 (such as using pressure sensors 23*a*, 23*b*), and this feedback is used to change the degree to which the trolling valves TV1 are opened at 112. For example, if the clutch pressure is too high in a given transmission 20*a* or 20*b*, the appropriate trolling valve TV1 can be adjusted to decrease slip more gradually; if the clutch pressure is too low, the trolling valve TV1 can be adjusted to decrease slip more quickly. Once the clutch pressures at 118 indicate that TOS is equal to TIS, taking into account the transmissions' gear ratios, the first-gear clutches 72 are fully engaged and the full torque from the engines 16*a*, 16*b* is being used to drive the propellers 18*a*, 18*b*. The clutch pressures measured at 118 can also be used to determine feed-forward signals to adjust the current to the trolling valves TV1 and therefore the amount of slip. Either or both of the feedback and feedforward methods can be used to sync the TOS of the two (or more) marine propulsion devices 14*a*, 14*b*, which might otherwise vary given differences in the manufacturing, age, or run-time thereof.

In one example in which trolling valves TV1 are used, the control module 28 might spool the engines 16*a*, 16*b* to a predetermined (calibrated or user-selected) engine speed while engaging both the first (forward) clutches 72 via the trolling valves TV1 and the reverse clutches 70 via the reverse trolling valves TVR. Once the engines 16*a*, 16*b* are up to the predetermined speed, the control module 28 would release the reverse trolling valves TVR and eliminate forward slip via a calibrated ramp-out, until the first-gear clutches 72 were fully engaged. Such a method may include engaging the forward and reverse clutches 72, 70 only lightly (for example, 1-5% of full engagement pressure) to create net zero TOS. This allows pressure to build up on first-gear clutches 72, while preventing incidental thrust from being created while the transmissions are still in neutral.

As shown at 120, boost pressure from a turbo, in the case that the engines 16*a*, 16*b* are turbo-charged, can be measured and provided to the control module 28. The control module 28 might wait until the boost pressure is built up to a predetermined pressure before engaging the first-gear clutches 72. Such boosted engines would benefit greatly from reduced boost lag.

Either of the manual or automated modes described herein above could also use speed and/or acceleration feedback to modify launch during the next iteration of control. For example, data from the GPS 30 or the IMU/AHRS 26 could inform the control module 28 or operator how long it took for the marine vessel 12 to accelerate from a first speed to a second speed, how long it took the marine vessel 12 to travel a predetermined distance, or how long it took the marine vessel 12 to reach a predetermined vessel speed when the first-gear clutches 72 were engaged at a particular engine speed. The control module 28 or operator could then choose to engage the first-gear clutches 72 at a different engine speed during the next launch to improve launch even more. For example, if at clutch engagement at 3000 RPM the vessel took 4 seconds to accelerate to planing, but at clutch engagement at 4000 RPM the vessel took 3 seconds to accelerate to planing, the control module 28 or operator may choose to engage the first-gear clutches 72 at 4000 RPM during the next iteration of control in order to reduce the time it takes to get the marine vessel 12 on plane. Such optimization can be done iteratively, and can be undertaken by manual input from the operator or by carrying out automated algorithms with the control module 28.

Both of the above methods could be used in conjunction with vents in the propellers 18*a*, 18*b* of the marine propulsion devices 14*a*, 14*b*. Such vents would allow the propellers 18*a*, 18*b* to slip more while the engines 16*a*, 16*b* ramp up to the desired speed, thereby allowing the first-gear clutches 72 to be engaged sooner. Such combination of the above methodology with vented propellers would increase clutch life, because engaging the first-gear clutches 72 sooner means they are engaged at a lower engine speed, creating less wear. The control module 28 can also use TIS and TOS feedback to modulate clutch pressure to prevent clutch damage.

The first-gear clutches 72 may be designed as traditional wet clutches or as racing clutches for improved heat transfer, such as by including friction material, controlling lube flow rates, and/or groove designs.

The above methods allow an operator to experience enhanced acceleration of the marine vessel 12 due to the higher thrust available at launch. By allowing the engine speed and propeller speed to be de-coupled during an acceleration event, the engines 16*a*, 16*b* can operate higher on the torque curve during acceleration. Delivery of the torque to the propellers 18*a*, 18*b* can then be modulated by using the proportional trolling valves 25*a*, 25*b*. Additionally, the operator may be able to use higher pitch propellers, thereby resulting in better wide-open-throttle fuel economy and top vessel speed.

Figure 4:
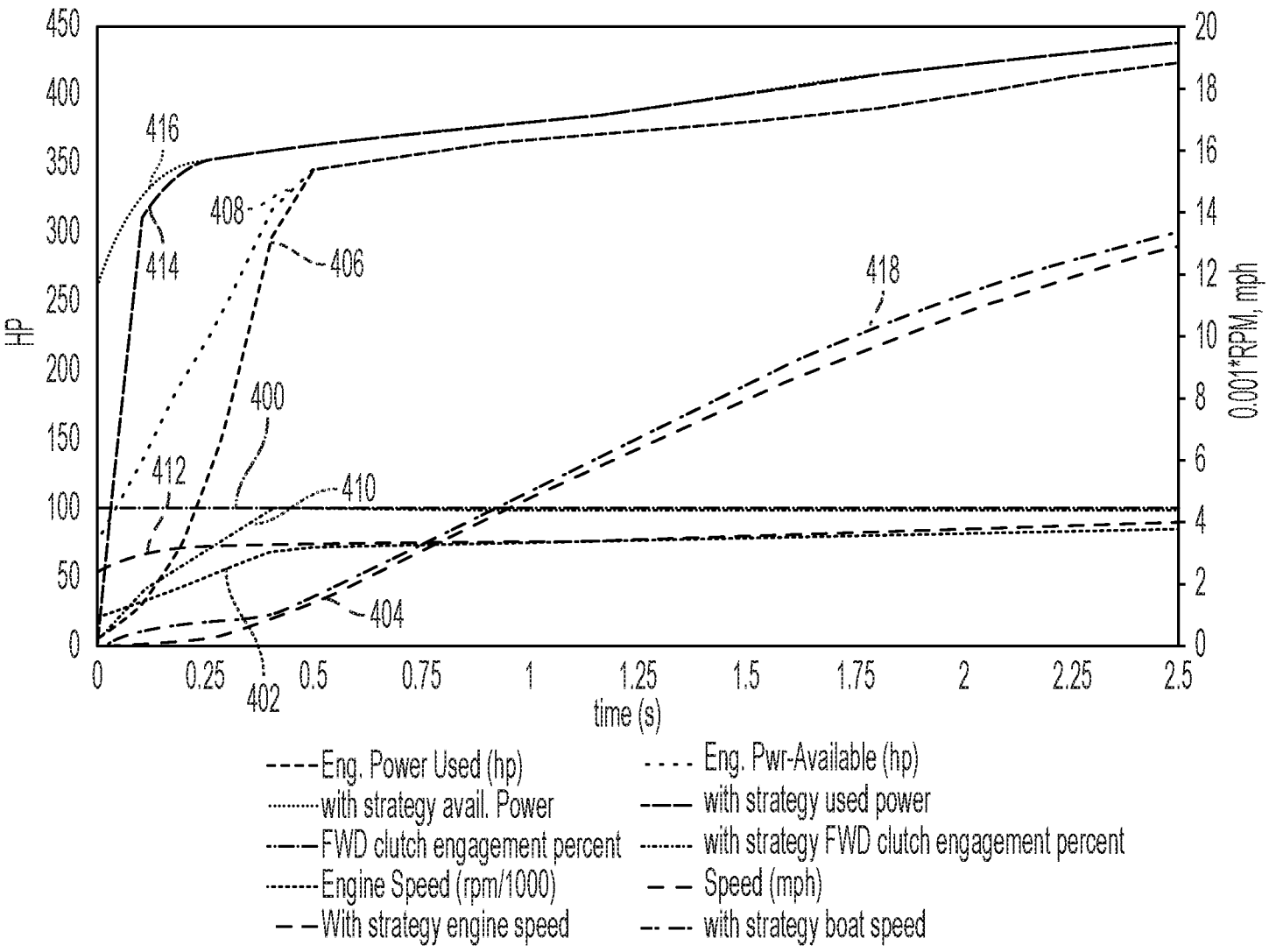
FIG. 4 illustrates a launch profile for a marine vessel using the present method versus a launch profile for a marine vessel not using the present method.

FIG. 4 illustrates exemplary launch profiles for a marine vessel using a method according to the prior art and a method according to the present disclosure. As shown at 400, according to the prior art method, the first-gear clutch 72 is fully (100%) engaged starting at time zero. Engine speed 402 slowly rises, thereby causing vessel speed 404 to slowly rise. The engine power used 406 does not match the engine power available 408 until about 0.5 seconds. Thus, there is un-tapped power potential.

In contrast, according to the method of the present disclosure, as shown at 410, the first-gear clutch 72 is not engaged at time 0, but is increasingly engaged via its associated trolling valve until reaching full engagement at about 0.4 seconds. Engine speed 412 is therefore ramped up to a little over 2000 RPM before the first-gear clutch 72 is engaged. Thus, the engine power used 414 more closely tracks the engine power available 416 (compare 406 and 408), and the two meet at about 0.25 seconds. As a result of using this available power sooner during launch, vessel speed 418 increases more quickly according to the present method between 0 and 0.3 seconds (compare vessel speed 404), and increases overall later on during launch (1+seconds).

Figure 5:
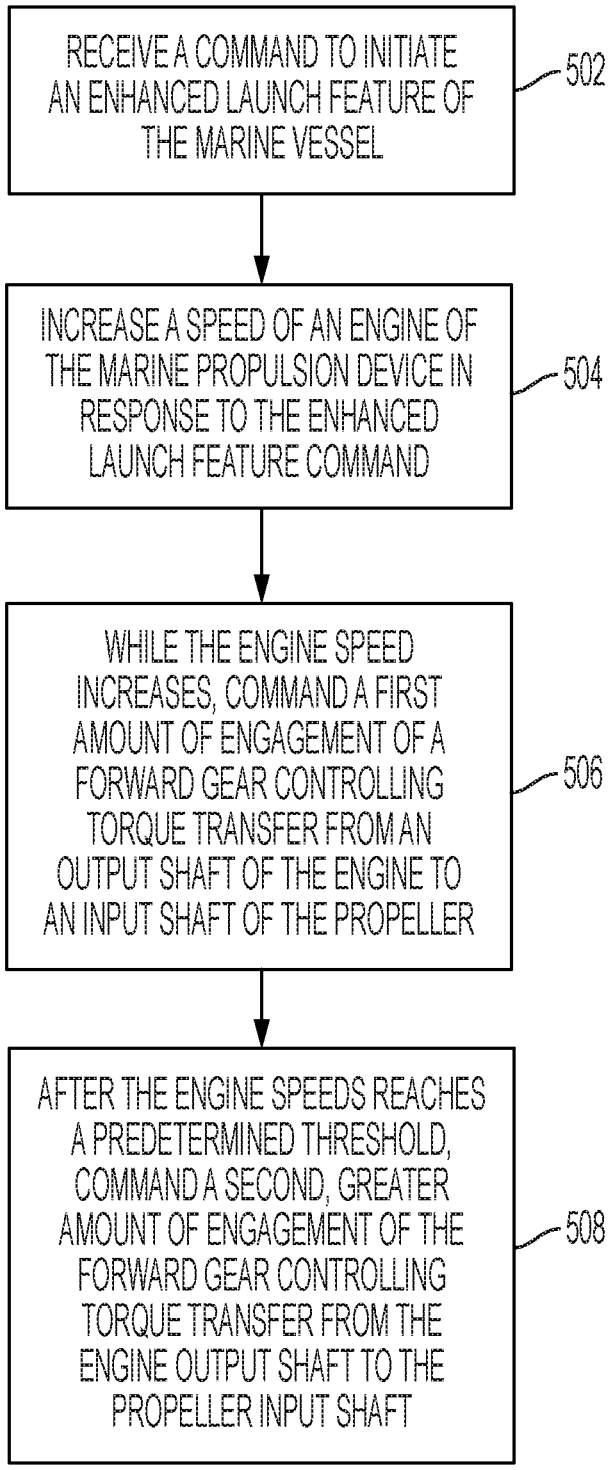
FIG. 5 illustrates a method for launching a marine vessel according to the present disclosure.

FIG. 5 illustrates one example of a method for controlling a speed of a propeller 18*a*, 18*b* of a marine propulsion device 14*a*, 14*b* during launch of a marine vessel 12 according to the present disclosure. The method is carried out by a control module 28 and comprises receiving a command to initiate an enhanced launch feature of the marine vessel 12, as shown at 502. The method next includes increasing a speed of an engine 16*a*, 16*b* of the marine propulsion device 14*a*, 14*b* in response to the enhanced launch feature command, as shown at 504. While the engine speed increases, the method includes commanding a first amount of engagement of a forward gear 52 controlling torque transfer from an output shaft of the engine to an input shaft of the propeller, as shown at 506. After the engine speed reaches a predetermined threshold, the method includes commanding a second, greater amount of engagement of the forward gear 52 controlling torque transfer from the engine output shaft to the propeller input shaft, as shown at 508. In one example, the first amount of engagement is no engagement such that there is no power transfer between the engine output shaft and the propeller input shaft. The second amount of engagement is full engagement such that there is full power transfer between the engine output shaft and the propeller input shaft.

In one example, commanding the second, greater amount of engagement of the forward gear 52 may include commanding the second, greater amount of engagement of the forward gear 52 automatically in response to the engine speed reaching the predetermined threshold. In an alternative example, commanding the second, greater amount of engagement of the forward gear 52 includes providing an operator of the marine vessel with an option to command the second, greater amount of engagement of the forward gear 52 in response to the engine speed reaching the predetermined threshold, and commanding the second, greater amount of engagement of the forward gear 52 in response to the operator selecting the option.

The method may also include controlling a trolling valve TV1 coupled to a clutch 72 associated with the forward gear 52 so as to control an amount of slip of the forward gear 52 and thereby provide the first and second amounts of engagement of the forward gear 52. This may include controlling the trolling valve TV1 so as to gradually decrease the amount of slip of the forward gear 52 and thereby gradually increase the amount of engagement of the forward gear 52 from the first amount to the second amount.

In some examples, the method includes commanding the first amount of engagement of the forward gear 52 while simultaneously commanding the first amount of engagement of a reverse gear 66 controlling torque transfer from the engine output shaft to the propeller input shaft. After the engine speed reaches the predetermined threshold, the method includes commanding disengagement of the reverse gear 66 and commanding an increasing amount of engagement of the forward gear 52. The method may include controlling trolling valves TV1, TVR coupled to respective clutches 72, 70 associated with the respective forward and reverse gears 52, 66 so as to control an amount of slip of the respective forward and reverse gears 52, 66 and thereby provide the amounts of engagement of the forward and reverse gears 52, 66.

As noted herein above, the forward gear 52 is part of a transmission 50 coupling the engine output shaft to the propeller input shaft, the transmission 50 comprising a clutch 72 associated with the forward gear 52 and a trolling valve TV1 associated with the clutch 72. The method may further comprise measuring at least one of an output speed of the transmission 50 and a pressure in the clutch 72 and using the at least one of the measured transmission output speed and the measured clutch pressure to control an amount of slip provided by the trolling valve TV1.

According to another example, a system for a marine vessel 12 includes a marine propulsion device 14*a*, 14*b* having an engine 16*a*, 16*b* coupled via a transmission 20*a*, 20*b* to a propeller 18*a*, 18*b*, a control module 28 controlling the marine propulsion device 14*a*, 14*b*, and an operator input device 36, 42 in signal communication with the control module. The control module 28 is configured to carry out an enhanced launch algorithm in response to an enhanced launch feature command from the operator input device 36, 42. The control module 28 increases a speed of the engine 16*a*, 16*b* in response to the enhanced launch feature command. While the engine speed increases, the control module 28 controls the transmission 20*a*, 20*b* to provide a first amount of power-transferring engagement between the engine 16*a*, 16*b* and the propeller 18*a*, 18*b*. After the engine speed reaches a predetermined threshold, the control module 28 controls the transmission 20*a*, 20*b* to provide a second, greater amount of power-transferring engagement between the engine 16*a*, 16*b* and the propeller 18*a*, 18*b*. The first amount of power-transferring engagement between the engine 16*a*, 16*b* and the propeller 18*a*, 18*b* is no engagement. The second amount of power-transferring engagement between the engine 16*a*, 16*b* and the propeller 18*a*, 18*b* is full engagement.

In one example, the control module 28 controls the transmission 20*a*, 20*b* to provide the second, greater amount of power-transferring engagement between the engine 16*a*, 16*b* and the propeller 18*a*, 18*b* automatically in response to the engine speed reaching the predetermined threshold. In another example, the control module 28 provides an operator of the marine vessel 12 with an option to command the second, greater amount of power-transferring engagement between the engine 16*a*, 16*b* and the propeller 18*a*, 18*b* in response to the engine speed reaching the predetermined threshold. The control module 28 commands the second, greater amount of power-transferring engagement between the engine 16*a*, 16*b* and the propeller 18*a*, 18*b* in response to the operator selecting the option.

In some examples, the transmission 20*a*, 20*b* comprises a trolling valve TV1 coupled to a clutch 72 associated with a forward gear 52, and the control module 28 controls an amount of slip of the forward gear 52 to thereby provide the first and second amounts of power-transferring engagement between the engine 16*a*, 16*b* and the propeller 18*a*, 18*b*. The control module 28 controls the trolling valve TV1 so as to gradually decrease the amount of slip of the forward gear 52 and thereby gradually increase the amount of power-transferring engagement between the engine 16*a*, 16*b* and the propeller 18*a*, 18*b* from the first amount to the second amount.

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

What is claimed is:

1. A method for controlling a speed of a propeller of a marine propulsion device during launch of a marine vessel, the method being carried out by a control module and comprising:

receiving a command to initiate an enhanced launch feature of the marine vessel;

increasing a speed of an engine of the marine propulsion device in response to the enhanced launch feature command;

while the engine speed increases, commanding a first amount of engagement of a forward gear controlling torque transfer from an output shaft of the engine to an input shaft of the propeller; and after the engine speed reaches a predetermined threshold, commanding a second, greater amount of engagement of the forward gear controlling torque transfer from the engine output shaft to the propeller input shaft;

wherein the forward gear is part of a transmission coupling the engine output shaft to the propeller input shaft, the transmission comprising a clutch associated with the forward gear and a trolling valve associated with the clutch, and the method further comprises:

measuring at least one of an output speed of the transmission and a pressure in the clutch; and using the at least one of the measured transmission output speed and the measured clutch pressure to control an amount of slip provided by the trolling valve.

2. The method of claim 1, wherein commanding the second, greater amount of engagement of the forward gear comprises commanding the second, greater amount of engagement of the forward gear automatically in response to the engine speed reaching the predetermined threshold.

3. The method of claim 1, wherein commanding the second, greater amount of engagement of the forward gear comprises providing an operator of the marine vessel with an option to command the second, greater amount of engagement of the forward gear in response to the engine speed reaching the predetermined threshold, and commanding the second, greater amount of engagement of the forward gear in response to the operator selecting the option.

4. The method of claim 1, further comprising controlling the trolling valve coupled to the clutch associated with the forward gear so as to control the amount of slip of the forward gear and thereby provide the first and second amounts of engagement of the forward gear.

5. The method of claim 4, further comprising controlling the trolling valve so as to gradually decrease the amount of slip of the forward gear and thereby gradually increase the amount of engagement of the forward gear from the first amount to the second amount.

6. The method of claim 1, wherein the second amount of engagement is full engagement such that there is full power transfer between the engine output shaft and the propeller input shaft.

7. A method for controlling a speed of a propeller of a marine propulsion device during launch of a marine vessel, the method being carried out by a control module and comprising:

receiving a command to initiate an enhanced launch feature of the marine vessel;

increasing a speed of an engine of a marine propulsion device in response to the enhanced launch feature command;

while the engine speed increases, commanding a first amount of engagement of a forward gear controlling torque transfer from an output shaft of the ending to an input shaft of the propeller;

after the engine speed reaches a predetermined threshold, commanding a second, greater amount of engagement of the forward gear controlling torque transfer from the engine output shaft to the propeller input shaft;

commanding the first amount of engagement of the forward gear while simultaneously commanding the first amount of engagement of a reverse gear controlling torque transfer from the engine output shaft to the propeller input shaft; and after the engine speed reaches the predetermined threshold, commanding disengagement of the reverse gear and commanding an increasing amount of engagement of the forward gear.

8. The method of claim 7, further comprising controlling trolling valves coupled to respective clutches associated with the respective forward and reverse gears so as to control an amount of slip of the respective forward and reverse gears and thereby provide the amounts of engagement of the forward and reverse gears.

9. A method for controlling a speed of a propeller of a marine propulsion device during launch of a marine vessel, the method being carried out by a control module and comprising:

receiving a command to initiate an enhanced launch feature of the marine vessel;

increasing a speed of an engine of a marine propulsion device in response to the enhanced launch feature command;

while the engine speed increases, commanding a first amount of engagement of a forward gear controlling torque transfer from an output shaft of the ending to an input shaft of the propeller; and after the engine speed reaches a predetermined threshold, commanding a second, greater amount of engagement of the forward gear controlling torque transfer from the engine output shaft to the propeller input shaft;

wherein the first amount of engagement is no engagement such that there is no power transfer between the engine output shaft and the propeller input shaft.

10. A method for controlling a speed of a propeller of a marine propulsion device during launch of a marine vessel, the method being carried out by a control module and comprising:

receiving a command to initiate an enhanced launch feature of the marine vessel;

increasing a speed of an engine of a marine propulsion device in response to the enhanced launch feature command;

while the engine speed increases, commanding a first amount of engagement of a forward gear controlling torque transfer from an output shaft of the ending to an input shaft of the propeller; and after the engine speed reaches a predetermined threshold, commanding a second, greater amount of engagement of the forward gear controlling torque transfer from the engine output shaft to the propeller input shaft;

wherein a position of a throttle lever associated with the marine propulsion device does not correspond to the engine speed.

11. A system for a marine vessel, the system comprising:

a marine propulsion device having an engine coupled via a transmission to a propeller;

a control module controlling the marine propulsion device; and an operator input device in signal communication with the control module;

wherein the control module is configured to carry out an enhanced launch algorithm in response to an enhanced launch feature command from the operator input device;

wherein the control module increases a speed of the engine in response to the enhanced launch feature command;

wherein, while the engine speed increases, the control module controls the transmission to provide a first amount of power-transferring engagement between the engine and the propeller;

wherein, after the engine speed reaches a predetermined threshold, the control module controls the transmission to provide a second, greater amount of power-transferring engagement between the engine and the propeller;

wherein the control module provides an operator of the marine vessel with an option to command the second, greater amount of power-transferring engagement between the engine and the propeller in response to the engine speed reaching the predetermined threshold; and wherein the control module commands the second, greater amount of power-transferring engagement between the engine and the propeller in response to the operator selecting the option.

12. The system of claim 11, wherein the transmission comprises a trolling valve coupled to a clutch associated with a forward gear, wherein the control module controls an amount of slip of the forward gear to thereby provide the first and second amounts of power-transferring engagement between the engine and the propeller.

13. The system of claim 12, wherein the control module controls the trolling valve so as to gradually decrease the amount of slip of the forward gear and thereby gradually increase the amount of power-transferring engagement between the engine and the propeller from the first amount to the second amount.

14. The system of claim 11, wherein the first amount of power-transferring engagement between the engine and the propeller is no engagement.

15. The system of claim 11, wherein the second amount of power-transferring engagement between the engine and the propeller is full engagement.

* * * * *